US005405262A

United States Patent [19]

Appel

[11] Patent Number: 5,405,262

[45] Date of Patent: Apr. 11, 1995

[54] ADJUSTABLE BURNING CANNED HEATING APPARATUS

[76] Inventor: Ron I. Appel, 12631 Newport Ave., Tustin, Calif. 92680

[21] Appl. No.: 255,914

[22] Filed: Jun. 7, 1994

[51] Int. Cl.[6] ..... F23D 3/24

[52] U.S. Cl. ..... 431/320; 431/323; 431/325; 126/43; 126/45

[58] Field of Search ..... 431/320, 315, 310, 309, 431/302, 298, 325; 126/43, 45, 46, 265

[56] References Cited

U.S. PATENT DOCUMENTS

| | | | |
|---|---|---|---|
| 960,064 | 5/1910 | Bergstein . | |
| 3,262,290 | 7/1966 | Huber | 67/57 |
| 3,888,620 | 6/1975 | Devon | 431/321 |
| 4,002,235 | 1/1977 | Donnelly | 206/219 |
| 4,188,938 | 2/1980 | Hasenfratz | 126/43 |
| 4,380,992 | 4/1983 | Spring | 126/43 |
| 4,604,053 | 8/1986 | de la Rosa | 431/320 |
| 4,611,986 | 9/1986 | Menter | 431/320 |
| 4,624,633 | 11/1986 | Bandel | 431/320 |
| 4,850,858 | 7/1989 | Blankenship et al. | 126/45 X |
| 5,012,791 | 5/1991 | McCabe | 126/43 |
| 5,302,114 | 4/1994 | Kiefer et al. | 431/320 |
| 5,307,799 | 5/1994 | Scanvato et al. | 126/43 |

*Primary Examiner*—Larry Jones
*Attorney, Agent, or Firm*—Gary Appel

[57] ABSTRACT

A disposable, adjustable flame, canned fuel apparatus comprises a container having closed sides and bottom and having an open top; a fuel absorbent pad disposed in upper regions of the container relatively adjacent to its open top; a flammable liquid disposed in the container; an elongate wick disposed in the container and having an upper end region in fluid communication with the pad and having a lower end region extending into lower regions of the container and into the flammable liquid contained therein; and an adjustable flame assembly attached across the top of the container. Such assembly includes a first member non-rotatably attached to the container and a second member that is mounted for rotational movement relative to the first member or the first member mounted for rotational movement relative to the second member and a second member that is non-rotatably attached to the container or both first and second members mounted to the container for rotational movement relative to each other, the first member having a plurality of apertures opening to an upper surface of the fuel absorbent pad and the second member having a like number of similar apertures and being rotatable between a first rotational position relative to the first member in which the apertures in the first member are covered by the second member and a second rotational position in which the apertures in the first member are at least substantially uncovered for maximum burning of fuel in the container. In rotational positions intermediate the first and second positions, the apertures in the first member are partially closed. The pad is formed of a mixture of fiberglass and cotton, the cotton being present in an amount of between about fifteen percent and about eighty-five percent. A seal is provided for retaining the flammable fluid in the container until use.

22 Claims, 3 Drawing Sheets

(CLOSED)

(FULL OPEN)

(PARTIALLY OPEN)

ADJUSTABLE BURNING CANNED HEATING APPARATUS

BACKGROUND OF THE INVENTION

1. Field of the Invention

The present invention relates generally to the field of heating and cooking apparatus and more particularly to disposable, canned fuel heating and cooking devices.

2. Background Discussion

The use of disposable, self-contained canisters or containers of heating and cooking fuel is widely known for camping and in emergency situations where utility sources of gas and electricity are out of service, for example, in the event of earthquakes, hurricanes and other disasters. One common type of such cans of heating and cooking fuel is STERNO, which is sometimes referred to as "canned heat." STERNO cans are similar in appearance and construction to half-pint paint cans and have the same type of removable and replaceable covers as paint cans. The fuel contained in the cans is a gel-type fuel. In use, the cover is removed and the fuel is ignited to provide a flame. A cooking utensil is placed on top of the can for cooking purposes. Such cans of heating and cooking fluid are relatively inexpensive, are readily stored for protracted periods of time and are disposable when the contained fuel is completely consumed.

Other types of canned fuel heating and cooking devices are also known. For example, U.S. Pat. No. 4,624,633 to David Bandel discloses a high percentage glycol fuel and a fuel canister used to contain the fuel. A wick protruding from the top of the canister provides a flame for heating and cooking. U.S. Pat. No. 4,611,986 to J. Alan Mentor discloses a particular configuration for use with a canister of fuel, the wick, which extends upwardly from the top of the canister is split, flame control being provided by separation of the two wick sections.

As another example, U.S. Pat. No. 4,604,053 to Rudolpho de la Rosa discloses another fuel-containing canister device in which an elongated wick having two separate end regions that extend into the fuel contained in the canister. A central region of the wick is exposed for burning through an aperture in the top of the canister. Further, U.S. Pat. No. 3,888,620 to Harry J. Devon discloses a heat and cooking source that employs a solid wax contained in the burner canister. When exposed regions of a wick are lit, metal wires conduct heat into the body of wax in the canister, thereby melting it so that the fuel becomes a liquid which is readily burned to provide more heat than is provided, for example, by a wax candle.

U.S. Pat. No. 4,850,858 to Robert J. Blankenship et al discloses another type of canned heat device in which a disc-shaped plastic foam burner pad is disposed at the top of a liquid fuel canister, a wick extending between the pad and fuel in the container wicks fuel into the foam pad. A central region of the plastic foam pad is exposed through an opening in the top of the canister and is lit to provide a heating and cooking flame.

U.S. Pat. Nos. 960,064 to Samuel Bergstein and No. 3,262,290 to Georg Huber disclose other types of liquid fuel burners.

One disadvantage of such known heating and cooking devices is that the control of the amount of flame and heating area is difficult to vary according to particular user needs. For example, the more simple devices provide no burning control whatsoever. Once lit and burning, the fuel provides a generally uniform heat output until the fuel is entirely consumed. Depending upon the use, such lack of control of heat output is undesirable and the result may be burned food, excessive heat (for example, in a small tent) and very rapid consumption of fuel. In other devices, the extent of burning control is not adequate for many uses where heat control, such as is commonly provided by a conventional gas or electric stove, is needed.

For these and other reasons, the present inventor has invented an improved, flame adjustable fuel container apparatus in which the amount of burning and heat provided by combustion of the contained fuel is adjustable over a wide range between an "off" condition, to a full "open" condition.

SUMMARY OF THE INVENTION

In accordance with the present invention there is provided a flame adjustable canned fuel apparatus which comprises a container for holding a quantity of flammable liquid, the container having closed sides and bottom and having an open top; a fuel absorbent pad disposed in upper regions of the container relatively adjacent to the open top; and an elongated wick disposed in the container, the wick having an upper end region in fluid communication with the pad and having a lower end region extending into lower regions of the container.

Included in the apparatus is an adjustable flame assembly that is attached across the top of the container. Such assembly includes a first member non-rotatably attached to the container and a second member that is mounted for rotational movement relative to the first member. The first member has at least one aperture opening to an upper surface of the pad and the second member is configured so that in a first rotational position relative to the first member, at least one aperture in the first member is covered by the second member and in a second rotational position relative to the first member, at least one aperture in the first member is at least substantially uncovered.

The second member is constructed so that in rotational positions intermediate its first and second positions, at least one aperture in the first member is partially closed. Accordingly, rotational movement of the second member relative to the first member enables the manual adjustment of the amount of the pad that is exposed through at least one aperture in the first member, thereby enabling the amount of heat provided by the pad, when it is lit, to be varied according to the amount of heat required, the length of the burning time of the apparatus being thereby also controlled.

Preferably, both the first and second members are provided with a number of apertures so that a uniform burning and heat release over the top of the apparatus is enabled.

A flammable liquid, such as alcohol, is contained in the container. A seal is preferably provided for retaining the flammable fluid in the container and keeping it from evaporating during storage. In an embodiment, the seal comprises a removable metal foil disposed between the first and second members of the adjustable flame assembly, the seal being adhered to the first member and upper edges of the container.

In accordance with a preferred embodiment of the invention, the pad is formed of a mixture of fiberglass which is non-combustible and cotton which is combustible, the percentage of cotton preferably varying from about fifteen percent to about eighty-five percent. By increasing the cotton content (that is, its percentage in the composition), the rate of burning of the apparatus is increased over the rate of burning in the apparatus when a lower percentage of cotton is present. Different burn rate and heat providing types of apparatus can thereby be provided and can be selected by buyers according to their particular requirements.

The adjustable flame assembly is not limited to a first member non-rotatably attached to the container and a second member that is mounted for rotational movement relative to the first member. Instead, the first member can be constructed for rotational movement and the second member can be non-rotatable or both first and second members can be constructed for rotational movement.

BRIEF DESCRIPTION OF THE DRAWINGS

The present invention can be more readily understood by a consideration of the following detailed description when taken in conjunction with the accompanying drawings, in which:

FIG. 4*a* shows relative rotational movement between the first and second members of the flame adjusting portion of the apparatus with the holes in the two members are unaligned so that burning of the fuel in the apparatus is prevented. FIG. 4*b* shows relative rotation between the first and second members so that the holes in the members are fully aligned so that maximum burning of the fuel in the container is enabled. FIG. 4*c* shows an intermediate relative rotational positioning of the first and second members so that the holes in each are only partly aligned so as to restrict the burning rate of fuel in the apparatus.

In the various FIGS. identical elements and features are given the same reference number.

DETAILED DESCRIPTION OF THE INVENTION

Figure 1:
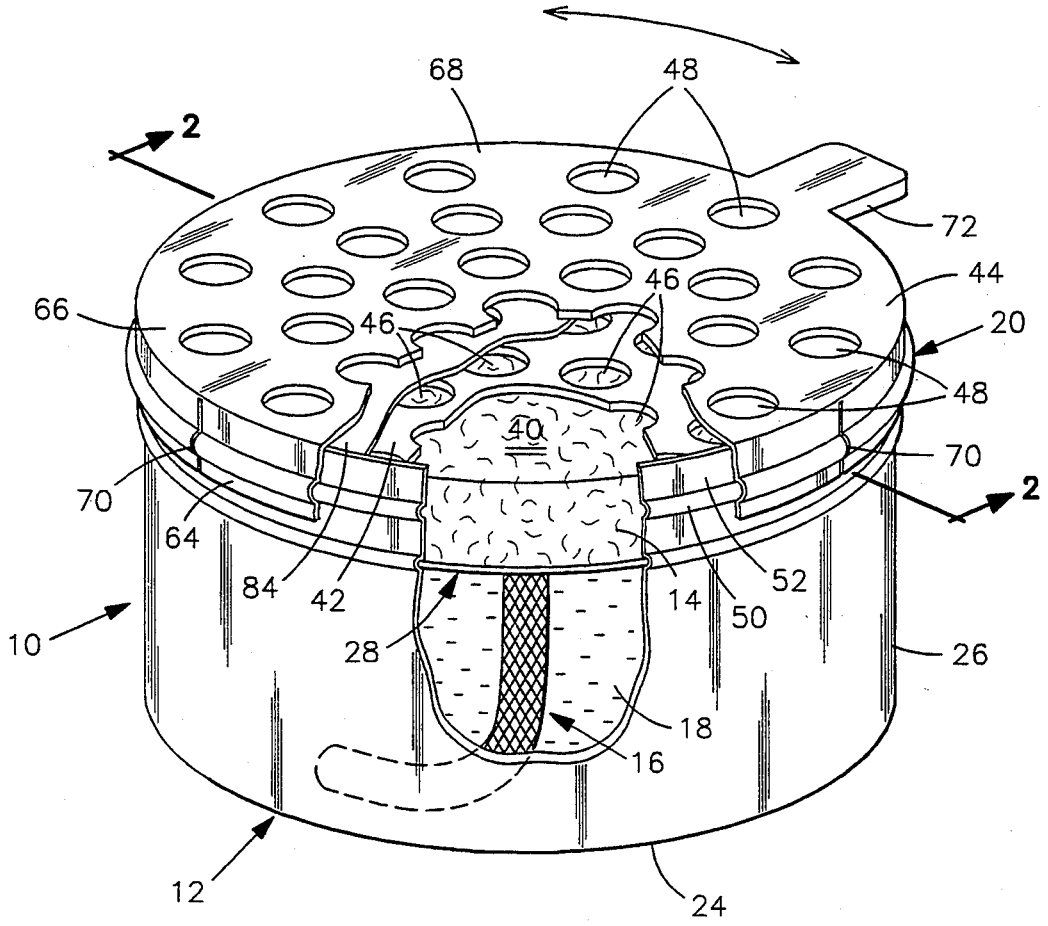
FIG. 1 is a partially cut-away perspective drawing of a disposable, adjustable flame, liquid fuel apparatus showing the construction thereof.
Figure 2:
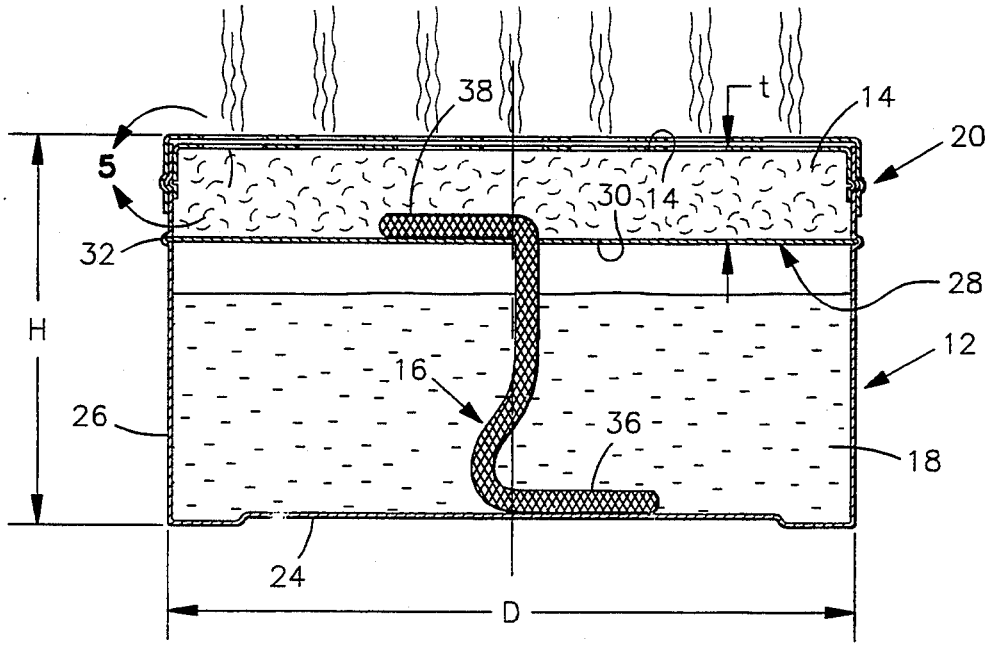
FIG. 2 is a cross sectional drawing taken along line 2—2 of FIG. 1 showing additional features of the apparatus and showing the use of first and second members at the top of the container portion of the apparatus for enabling adjustment of the flame of the apparatus, the first and second members being formed having a number of circular holes that can be opened or closed to control the burning of the fuel in the apparatus.

There is shown in FIGS. 1 and 2 a disposable, flame adjusting, liquid fuel apparatus 10 in accordance with the present invention. Generally comprising apparatus 10, as more particularly described below, are a container or canister 12, a burner pad 14 disposed in upper regions of the container, a wick 16 disposed in the container, liquid fuel 18 contained in the container, and a flame adjusting assembly 20.

Container 12 is formed having a closed bottom 24 and closed sides or side wall 26, being open at the top (FIG. 2). As shown, container 12 is generally cylindrical in shape. With no limitation intended or implied, container 12 may conveniently have a diameter, D, of about three inches and a side height, H, of about two inches, and may be constructed of aluminum or tin.

Burner pad 14 is preferably the same diameter as container 12 and may have a thickness, t, of about one-quarter to three-eights of an inch. Pad 14 is preferably constructed of a mixture of fiberglass, which is essentially non-burning, and cotton which is consumed in the burning process. The amount of cotton contained in pad 14 may, for example, vary from about fifteen percent to about eighty-five percent. To a large extent, the percentage of cotton comprising pad 14 determines the burning rate of fuel 18 in apparatus 10, all other facts being the same. That is, the greater the percentage of cotton, the faster fuel 18 burns and the greater is the heat output rate (for example, in BTU's per given period of time).

As shown in FIGS. 1 and 2, pad 14 may be retained in place by a retainer disc 28 which may be formed of a metal screen or mesh and upon which a lower surface 30 of the pad rests. Retainer disc 28 may, in turn, be held in place b the edges thereof being received in an annular groove or bead 32 formed outwardly around side wall 26 of container 12.

Wick 16 comprises an elongate section or strip of conventional wick material, such as woven cotton. A lower end region 36 of wick 16 extends to the bottom of container 12 so as to remain in contact with fuel 18 as long as any fuel remains in container 12 (FIG. 2). An upper end region 38 of wick 16 extends through retainer 28 and into fuel transfer contact with under surface 40 of pad 14 (FIG. 2). Liquid fuel 18 is thereby caused to be soaked into pad 14 to enable the burning of fuel from the pad.

Flame adjusting assembly 20, which is attached across the open top of container 12, is configured for causing a selective area exposure of an upper surface 40 of pad 14 to the air for burning of fuel 18 that has been wicked into the pad by wick 16. As shown by way of example in FIGS. 1 and 2, assembly 20 comprises first and second circular members 42 and 44, respectively. Members 42 and 44 are formed having at least one aperture 46 and 48, respectively. Preferably, as shown in FIG. 1, a large, like number of similar apertures 46 and 48 are formed in members 42 and 44. For reasons that will become apparent, the pattern of apertures 48 in second member 44 is identical to the pattern of apertures 46 in first member 42.

Figure 5:
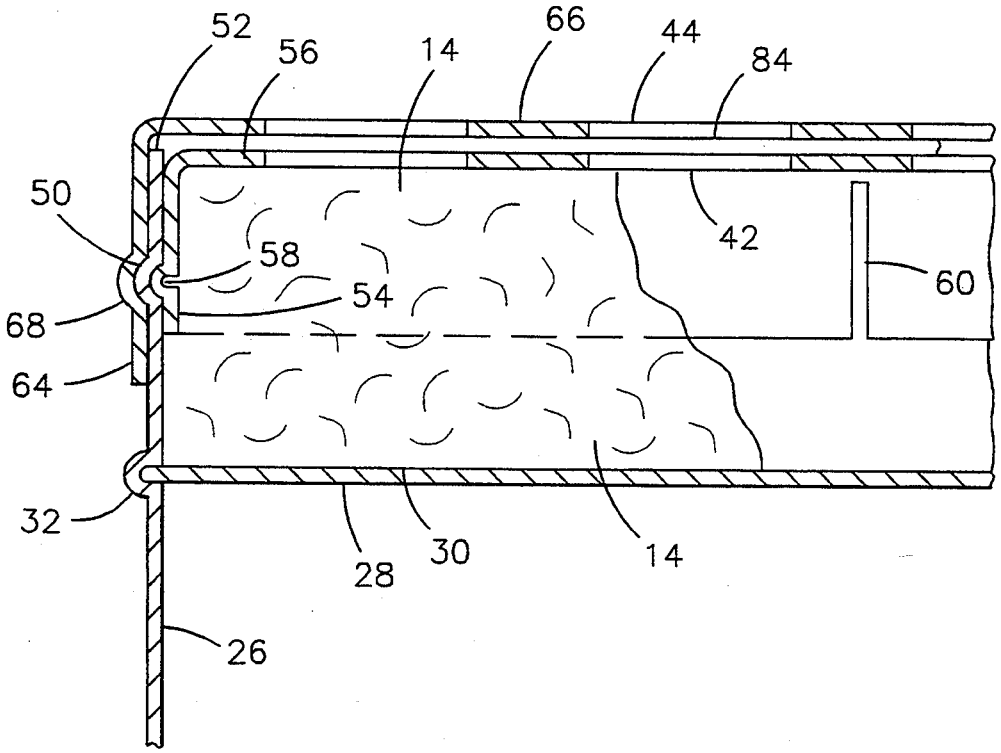

First member is non-rotatably attached to the top of container 12. Such attachment may be accomplished by forming an annular bead 50 outwardly around container side 26 adjacent an upper edge 52 of such side, as best seen in FIG. 5. First member 42 is constructed having a narrow flange 54 that extends downwardly for a transverse, circular top portion 56. Extending around flange 54 is an annular bead 58 which is configured for snapping into bead 50 on container side 26 when the first member is forced downwardly into container 12. An interference fit between bead 58 of first member 42 and bead 50 of container prevents rotational movement of the first member relative to the container. The snapping of first member 42 into container 12 in the above-described manner may be facilitated by forming first member flange 54 with one or more narrow vertical slits 60 (FIG. 5).

Second member 44 is constructed to be rotatably attached to container 12. To this end, second member 44 is constructed having a narrow flange 64 which projects downwardly from a top, transverse portion 66 (FIGS. 1 and 5). An annular bead 68 is formed around second member flange 64 and is sized to fit closely but not tightly over bead 50 formed around container side 26 when second member 44 is snapped into place onto container 12.

One or more slits 70 may be formed vertically in second member flange 64 to enable snapping of second member 44 into place onto container 12. Second member 44 fits sufficiently loosely onto container 12 so that the second member can be rotated around the container, for example, by the use of a tab 72 which projects sidewardly from the second member. On the other hand, second member 44 fits snugly enough onto container 12 that the second member is frictionally retained in whatever rotational position it is moved into.

Figure 4A:
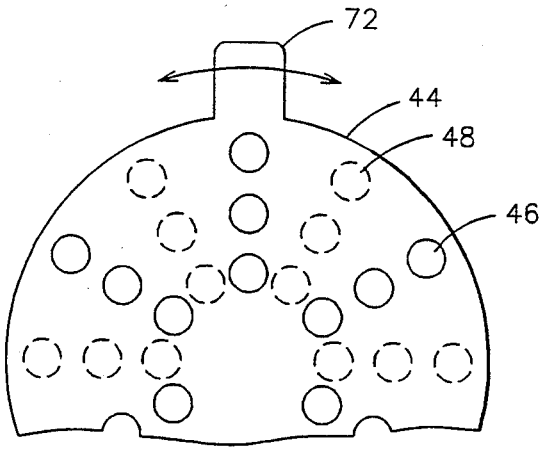
FIGS. 4*a*–4*c* are a series of views showing operation of the flame adjusting portion of the apparatus.

Because the size and pattern of apertures 48 in second member 44 (FIGS. 4*a*, 4*b* and 4*c*) match the size and pattern of apertures 46 in first member 42, it can be appreciated that in a certain, first rotational position of the second member relative to the first member, apertures 46 in the first member are closed by regions between apertures 48 in the second member. Depending upon the number and pattern of apertures 46 and 48, more than one of such first rotational positions may be provided.

Figure 4B:
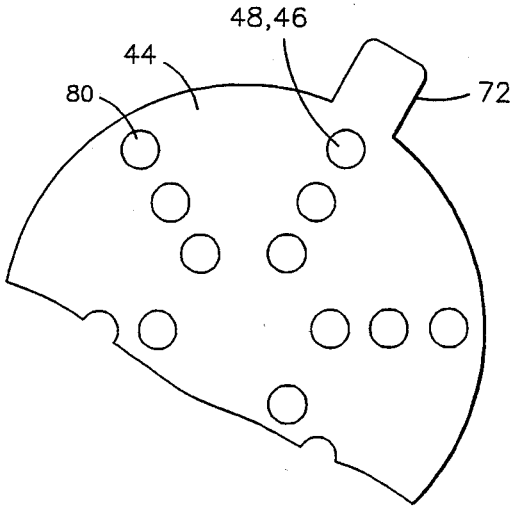
Figure 4C:
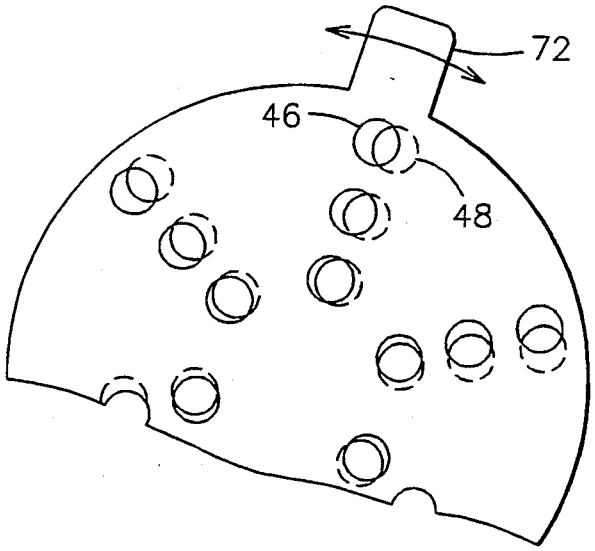

Second member 44 can them be rotated to a second rotational position relative to first member 42 such that apertures 48 in the second member are aligned over apertures 46 in first member 42 (FIG. 4*b*). In this second position, exposed regions 80 of pad 14 can be lit and will burn. Again, according to the number and pattern of apertures 46 and 48, more than one of such second rotational positions may be provided.

It will be apparent that for rotational positions of second member 44 relative to first member 42 intermediate the above-described first (closed) and second (open) positions, apertures 46 in the first member 42 may be partially exposed through apertures 48 in the second member (FIG. 4*c*), thereby providing a selectively variable burning area of pad 14. The amount of heat provided by apparatus 10 can accordingly be adjusted between none (second member 44 in its first, closed position) and full burning (the second member in its second, open position).

Figure 3:
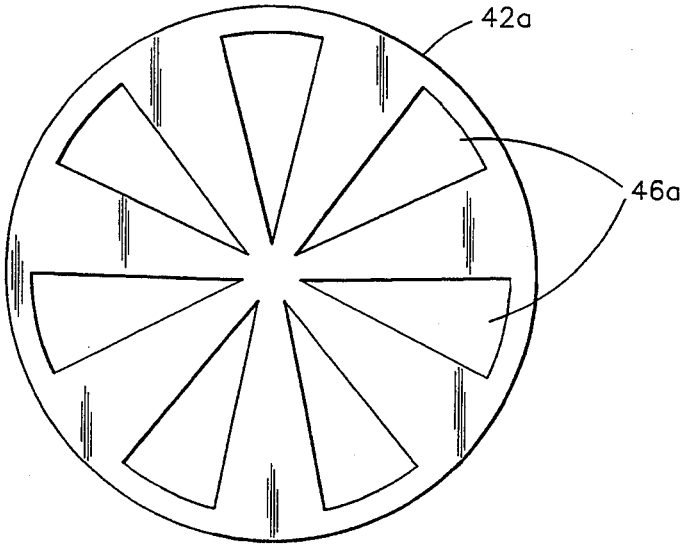
FIG. 3 is a plan view of a variation flame adjustment means which includes a plurality of wedge- or segment-shaped apertures that can be opened or closed to control the burning of fuel in the apparatus.

The size and shape of the apertures in first and second members 42 and 44 may, of course, be different from relatively small and circular. For example, there is depicted in FIG. 3 a first member 42*a* having triangular or circular segment-shaped apertures 46*a*. In such case, similar sized, shaped and spaced apertures would be formed in the second member (not shown).

It is generally desirable in the use of liquid fuel 18 in container 12 to seal apparatus 10 against leakage and evaporation of the fuel. This is desirable not only to enabling the storing and transportation by apparatus 10 in a safe manner, but also to prevent the possible formation of an explosive fuel-air mixture in storage areas.

One manner of sealing container 12 closed is to install a metal foil seal 84 across the top of the container over first member 42, as depicted in FIG. 1. Seal 84 is preferably sealed around upper edge 52 of container 12 after first member is attached to the container in the manner described above. Second member 44 can then be snapped onto container 12 over both seal 84 and first member 42. When use is to be made of apparatus 10, second member 44 is unsnapped from container 12, seal 84 is pealed away and the second member is then snapped back onto the container. Seal 84 may be made so that it can reseal container 12 if desired. In which case, the reverse process of unsealing would be followed.

Although there has been described and illustrated a disposable, adjustable flame, canned fuel apparatus for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. A flame adjustable canned fuel apparatus which comprises:

a. a container for holding a quantity of flammable liquid, said container having closed sides and bottom and having an open top;

b. a fuel absorbent pad disposed in upper regions of said container relatively adjacent to said open top, said pad being formed of a composite mixture of a combustible material and a non-combustible material;

c. an elongate wick disposed in said container, said wick having an upper end region in fluid communication with said pad and having a lower end region extending into lower regions of said container; and d. An adjustable flame assembly attached across the top of the container, said assembly including a first member non-rotatably attached to the container and a second member that is mounted for rotational movement relative to the first member, said first member having at least one aperture opening to an upper surface of said pad and said second member being configured so that in a first rotational position relative to the first member, said at least one aperture in the first member is covered by the second member and so that in a second rotational position relative to the first member, said at least one aperture in the first member is at least substantially uncovered.

2. The flame adjustable canned fuel apparatus as claimed in claim 1, wherein said pad is formed of a mixture of fiberglass and cotton.

3. The flame adjustable canned fuel apparatus as claimed in claim 1, including a flammable liquid contained in said container.

4. The flame adjustable canned fuel apparatus as claimed in claim 3, including a seal for retaining said flammable fluid in said container.

5. The flame adjustable canned fuel apparatus as claimed in claim 4, wherein said seal comprises a removable metal foil disposed between said first and second members.

6. The flame adjustable canned fuel apparatus as claimed in claim 1, wherein said second member is constructed so that in rotational positions intermediate said first and second positions, said at least one aperture in the first member is partially closed.

7. A flame adjustable canned fuel apparatus which comprises:

a. a container having closed sides and bottom and having an open top;

b. a fuel absorbant pad disposed in upper regions of said container relatively adjacent to said open top, said pad being formed of a mixture of a combustible material and a non-combustible material;

c. a flammable liquid disposed in said container;

d. an elongate wick disposed in said container, said wick having an upper end region in fluid communication with said pad and having a lower end region extending into lower regions of said container and into the flammable liquid contained therein; and e. An adjustable flame assembly attached across the top of the container, said assembly including a first member non-rotatably attached to the container and a second member that is mounted for rotational movement relative to the first member, said first member having a plurality of apertures opening to an upper surface of said pad and said second member having a like number of apertures and being rotatable between a first rotational position relative to the first member in which the apertures in the first member are covered by the second member and a second rotational position in which the apertures in the first member are at least substantially uncovered.

8. The flame adjustable canned fuel apparatus as claimed in claim 7, wherein said pad is formed of a mixture of fiberglass and cotton.

9. The flame adjustable canned fuel apparatus as claimed in claim 8, wherein said pad comprises between about fifteen percent and about eighty-five percent cotton.

10. The flame adjustable canned fuel apparatus as claimed in claim 7, including a seal for retaining said flammable fluid in said container.

11. The flame adjustable canned fuel apparatus as claimed in claim 10, wherein said seal comprises a removable metal foil disposed between said first and second members.

12. The flame adjustable canned fuel apparatus as claimed in claim 7, wherein said second member is constructed so that in rotational positions intermediate said first and second positions, said plurality of apertures in the first member are partially closed.

13. A flame adjustable canned fuel apparatus which comprises:

a. a container having closed sides and bottom and having an open top;

b. a fuel absorbant pad disposed in upper regions of said container relatively adjacent to said open top, said pad being formed of a mixture of a combustible material and a non-combustible material;

c. a flammable liquid disposed in said container;

d. an elongate wick disposed in said container, said wick having an upper end region in fluid communication with said pad and having a lower end region extending into lower regions of said container and into the flammable liquid contained therein;

e. an adjustable flame assembly attached across the top of the container, said assembly including a first member non-rotatably attached to the container and a second member that is mounted for rotational movement relative to the first member, said first member having a plurality of apertures opening to an upper surface of said pad and said second member having a like number of apertures and being rotatable between a first rotational position relative to the first member in which the apertures in the first member are covered by the second member and a second rotational position in which the apertures in the first member are at least substantially uncovered; and f. a seal for retaining said flammable fluid in said container.

14. The flame adjustable canned fuel apparatus as claimed in claim 13, wherein said pad is formed of a mixture of fiberglass and cotton.

15. The flame adjustable canned fuel apparatus as claimed in claim 14, wherein said pad comprises between about fifteen and about eighty-five percent cotton.

16. The flame adjustable canned fuel apparatus as claimed in claim 13, wherein said seal comprises a removable metal foil disposed between said first and second members.

17. The flame adjustable canned fuel apparatus as claimed in claim 13, wherein said second member is constructed so that in rotational positions intermediate said first and second positions, said plurality of apertures in the first member are partially closed.

18. The flame adjustable canned fuel apparatus as claimed in claim 13, wherein said first member is constructed for rotational movement and said second member is non-rotatable.

19. The flame adjustable canned fuel apparatus as claimed in claim 13, wherein said first member is constructed for rotation and said second member is constructed for rotation.

20. A flame adjustable canned fuel apparatus which comprises:

a. a container for holding a quantity of flammable liquid, said container having closed sides and bottom and having an open top;

b. a fuel absorbant pad disposed in upper regions of said container relatively adjacent to said open top;

c. an elongate wick disposed in said container, said wick having an upper end region in fluid communication with said pad and having a lower end region extending into lower regions of said container;

d. an adjustable flame assembly attached across the top of the container, said assembly including a first member non-rotatably attached to the container and a second member that is mounted for rotational movement relative to the first member, said first member having at least one aperture opening to an upper surface of said pad and said second member being configured so that in a first rotational position relative to the first member, said at least one aperture in the first member is covered by the second member and so that in a second rotational position relative to the first member, said at least one aperture in the first member is at least substantially uncovered;

e. a flammable liquid contained in said container; and f. a seal for retaining said flammable fluid in said container, said seal comprising a removable metal foil disposed between said first and second members:

21. A flame adjustable canned fuel apparatus which comprises:

a. a container having closed sides and bottom and having an open top;

b. a fuel absorbant pad disposed in upper regions of said container relatively adjacent to said open top;

c. a flammable liquid disposed in said container;

d. an elongate wick disposed in said container, said wick having an upper end region in fluid communication with said pad and having a lower end region extending into lower regions of said container and into the flammable liquid contained therein;

e. An adjustable flame assembly attached across the top of the container, said assembly including a first member non-rotatably attached to the container and a second member that is mounted for rotational movement relative to the first member, said first member having a plurality of apertures opening to an upper surface of said pad and said second member having a like number of apertures and being rotatable between a first rotational position relative to the first member in which the apertures in the first member are covered by the second member and a second rotational position in which the apertures in the first member are at least substantially uncovered; and f. a seal for retaining said flammable fluid in said container, said seal comprising a removable foil disposed between said first and second members.

22. A flame adjustable canned fuel apparatus which comprises:

a. a container having closed sides and bottom and having an open top;

b. a fuel absorbant pad disposed in upper regions of said container relatively adjacent to said open top;

c. a flammable liquid disposed in said container;

d. an elongate wick disposed in said container, said wick having an upper end region in fluid communication with said pad and having a lower end region extending into lower regions of said container and into the flammable liquid contained therein;

e. an adjustable flame assembly attached across the top of the container, said assembly including a first member non-rotatably attached to the container and a second member that is mounted for rotational movement relative to the first member, said first member having a plurality of apertures opening to an upper surface of said pad and said second member having a like number of apertures and being rotatable between a first rotational position relative to the first member in which the apertures in the first member are covered by the second member and a second rotational position in which the apertures in the first member are at least substantially uncovered; and f. a seal for retaining said flammable fluid in said container, said seal comprising a removable foil disposed between said first and second member.

* * * * *